US005580706A

United States Patent [19]

Ishigaki

[11] Patent Number: 5,580,706

[45] Date of Patent: Dec. 3, 1996

[54] METHOD FOR PROCESSING SILVER HALIDE PHOTOGRAPHIC MATERIALS USING AN AUTOMATIC DEVELOPING APPARATUS CONTAINING HOT ROLLERS

[75] Inventor: Kunio Ishigaki, Kanagawa, Japan

[73] Assignee: Fuji Photo Film Co., Ltd., Kanagawa, Japan

[21] Appl. No.: 498,923

[22] Filed: Jul. 6, 1995

Related U.S. Application Data

[63] Continuation of Ser. No. 141,507, Oct. 27, 1993, abandoned.

[30] Foreign Application Priority Data

Oct. 27, 1992 [JP] Japan ..... 4-288746

[51] Int. Cl.[6] ..... G03C 5/18; G03C 5/26; G03C 5/00; G03C 1/76

[52] U.S. Cl. ..... 430/403; 430/30; 430/350; 430/963; 430/536; 430/399; 430/400; 396/571; 396/579; 396/617

[58] Field of Search ..... 430/30, 350, 398, 430/400, 403, 517, 523, 531, 536, 963; 354/300, 319, 320, 321, 322, 323, 354; 219/469, 470

[56] References Cited

U.S. PATENT DOCUMENTS

| | | | |
|---|---|---|---|
| 1,943,687 | 1/1934 | Menke | 430/350 |
| 2,928,329 | 3/1960 | Limbach | 354/322 |
| 3,239,652 | 3/1966 | Price | 219/470 |
| 3,719,493 | 3/1973 | Forst | 430/963 |
| 4,231,164 | 11/1980 | Barbee | 34/16 |
| 5,281,513 | 1/1994 | Goto et al. | 430/523 |

FOREIGN PATENT DOCUMENTS

| | | | |
|---|---|---|---|
| 0355034 | 2/1990 | European Pat. Off. . | |
| 0456163 | 11/1991 | European Pat. Off. | 430/531 |
| 0560248 | 9/1993 | European Pat. Off. . | |
| 577471 | 3/1958 | Italy | 219/469 |
| 60-87323 | 5/1985 | Japan | 430/531 |
| 64-72158 | 3/1989 | Japan | 354/319 |
| 212484 | 4/1934 | United Kingdom | 430/523 |
| 1018879 | 2/1966 | United Kingdom | 430/523 |

OTHER PUBLICATIONS

JPA 05 093 985, Abstract.
JPA 63 049 760, Abstract.
JPA 05 805 8541, Abstract.
JPA 02298 945, Abstract.

*Primary Examiner*—Glenn A. Caldarola
*Assistant Examiner*—J. Pasterczyk
*Attorney, Agent, or Firm*—Sughrue, Mion, Zinn, Macpeak & Seas

[57] ABSTRACT

Disclosed is a method for processing a silver halide photographic material, having on one side of a support a hydrophobic polymer layer as the outermost layer and on the side opposite an emulsion layer, by means of an automatic developing apparatus. The apparatus has a drying operation part which is equipped with two or more hot rollers arranged so that the silver halide photographic material may be wrapped partly around each of the hot rollers in turn and the contact between the rollers and the material may alternate between the front surface and the back surface of the photographic material, whereby the moisture in the photographic material evaporates from the surface areas when they are not in contact with the hot rollers. This method results in improvements in the drying characteristics of the photographic material and the transportation characteristics of the automatic developing apparatus.

4 Claims, 2 Drawing Sheets

METHOD FOR PROCESSING SILVER HALIDE PHOTOGRAPHIC MATERIALS USING AN AUTOMATIC DEVELOPING APPARATUS CONTAINING HOT ROLLERS

This is a Continuation of application Ser. No. 08/141,507 filed Oct. 27, 1993, now abandoned.

FIELD OF THE INVENTION

The present invention relates to a method of processing silver halide photographic materials, particularly a silver halide photographic material which can exhibit improved drying characteristics in a drying step subsequent to a washing step and is quite suitable for rapid processing.

BACKGROUND OF THE INVENTION

In general a silver halide photographic material comprises a support, such as a plastic film, paper, plastic-coated paper, glass or so on, and a combination of layers coated thereon which contains light-sensitive emulsion layers and other constituent layers chosen optionally from interlayers, protective layers, backing layers, antihalation layers, antistatic layers and so on.

The printing arts have recently required that operations be carried out efficiently and speedily, so that there is a comprehensive need for the scanning operation to be speeded up and for the processing time of a photosensitive material to be shortened.

In order to meet these needs in the printing arts, it is desirable for an exposure apparatus (including a scanner and a plotter) to increase its scanning speed, and further not only to increase the number of its scanning lines but also to converge its scanning beams to heighten image quality. On the other hand, it is desirable for a silver halide photographic material to have high sensitivity and high stability and to be quite suitable for rapid photographic processing.

The term "rapid photographic processing" as used herein refers to processing which takes 15 to 60 seconds for the top of a photographic film to travel from the insertion slit of an automatic developing machine to the exit of the drying part of the machine via the developing tank, the transit part, the fixing tank, the transit part, the washing tank and the drying part in succession, and the developing machine is operated at a line speed of at least 1,000 mm/min.

As a means for shortening the photographic processing time, it is effective to shorten the drying time by improving the drying characteristics of the silver halide photographic material to be processed.

In order to effect such an improvement in the drying characteristics, there may be adopted a method of reducing the binder content in the silver halide photographic material. However, this method has the disadvantages of lowering the mechanical strength of the silver halide photographic material, causing a blackening problem with scratches, causing roller marks, and so on.

The blackening problem with scratches is a phenomenon in which abrasion has occurred on the film surfaces during the handling of the silver halide photographic films before development and the abraded part is blackened in a scratch pattern after development. Roller marks are a phenomenon in which the pressure imposed on the surface of a silver halide photographic film during photographic processing with an automatic developing machine varies depending on the fine roughness of the rollers used in the machine to cause black spotted unevenness in photographic density.

Both the blackening problem with scratches and roller marks impair considerably the value of silver halide photographic materials.

In the case of a silver halide photographic material having all of its silver halide emulsion layers on one side of a support (abbreviated as "one-sided emulsion material" hereinafter), drying characteristics can be improved by removing the light-insensitive hydrophilic colloid layers from the back side of the support or by using a hydrophobic binder in the light-insensitive layers provided on the back of the support. However, these measures are still unsatisfactory, so that further improvements in drying characteristics are required.

On the other hand, there are automatic developing machines which are equipped with a drying operation unit. In the drying operation unit, a photographic material swollen with water contained in every processing solution during photographic processing is dried as it is transported automatically. In general, hot air is blown upon the swollen material in the drying operation unit in order to remove the water contained therefrom. However, the hot-air drying method has the problem that when drying air is used repeatedly, taking into account the thermal efficiency, the water content in the drying air is increased gradually resulting in protracted drying.

Therefore, a way of drying a photographic material through direct or indirect heating with a heating means is to be considered. For instance, the combined use of hot rollers and drying air has been proposed as the heating means of a drying operation unit. More specifically, the drying operation unit is designed so that the air containing much moisture evaporated from the photographic material heated by a direct heating means (or hot rollers) can be removed from the vicinity of the surface of the photographic material by an indirect heating means (or drying air), thereby accelerating the drying speed. Accordingly, the drying time can be shortened.

In the drying step using hot rollers, a photographic material is, in general, kept traveling linearly, and heated by being held between a pair of hot rollers disposed at part of the traveling course. Further, drying air is blown on the heated photographic material to vaporize the water contained in the heated photographic material.

In the above-described drying process, however, the duration of the contact between the hot roller and the photographic material is very short since the photographic material is transported in the machine direction of the pair of hot rollers. Therefore, raising the temperature of the hot rollers (up to about 100 to 150° C.) is necessary for achieving the intended heating result within the short duration described above. When an operational problem occurs, the hot rollers heated to such a high temperature create a safety hazzard since an operator may want to start maintenance action including repairs as soon as possible. In addition, when there is jamming trouble with the photographic material, the photographic material is overdried at the part near the hot rollers causing a waving phenomenon, thereby losing its utility value. In particular, photographic materials for printing have a very thin support (75 to 100 μm in thickness), so that jamming trouble tends to occur and an undesirable drying result is apt to be produced in an overdried condition. Further, it is necessary to pay careful attention to the overdrying of a photographic material because of the severe requirement for dimensional stability in the graphic arts.

On the other hand, resources, produced gases, waste water, other various wastes, and so on have been reconsidered in many fields from the standpoint of environmental preservation. In the field of photographic processing, there is a growing need for reduction in replenishment rates of processing solutions used for processing photographic materials to save resources, reduce waste water and used vessels, and so on.

However, a reduction in the replenishment rate of a developer retards remarkably the progress of development. Similarly, the fixing speed is markedly decreased by a reduction in the replenishment rate of a fixer. Therefore, these processing solutions are usually replenished with fairly large quantities of replenishers (specifically, 250 to 500 ml of a replenisher for the development of 1 $m^2$ of photographic material, and 500 to 800 ml of a replenisher for the fixation of 1 $m^2$ of photographic material). With the intention of accelerating developing speed and fixing speed, each processing temperature is raised and the stirring condition of each processing solution is made more vigorous. These measures, however, cause various troubles such as generation of a bad smell, an increase in the cost of equipment, and so on.

Under these circumstances, it has been strongly desired to develop silver halide photographic materials having high suitability for rapid processing and enabling a reduction in replenishment rates of processing solutions.

SUMMARY OF THE INVENTION

A first object of the present invention is to provide a method of developing processing of a silver halide photographic material which exhibits improved drying characteristics in a drying step subsequent to a washing step and has excellent transport characteristics.

A second object of the present invention is to provide a method of developing processing of a silver halide photographic material which is highly suitable for rapid processing and enables a reduction in the replenishment rate of each processing solution.

These and other objects of the present invention are attained with a method of processing a silver halide photographic material which has been exposed to light and which comprises a support having at least one silver halide emulsion layer on one side thereof and a hydrophobic polymer layer as the outermost layer on the other side thereof, comprising the step of subjecting said photographic material to an automatic developing apparatus, wherein said apparatus comprises a drying operation unit equipped with at least two hot rollers which have a peripheral part heated with a heat source, said hot rollers being arranged so that the photographic material wraps partly around each of the hot rollers in turn, so that contact between the photographic material and the hot rollers alternates between the two sides of the photographic material, and so that heat is applied to the photographic material in an amount determined by the temperature of the peripheral part of the hot rollers and the duration of the contact between the photographic material and the hot rollers, whereby moisture in the photographic material evaporates from surface areas of the photographic material which are not in contact with the hot rollers and, a method disclosed above in which the peripheral temperature of each hot roller is determined by the temperature and the humidity of an atmosphere in which the automatic developing apparatus is placed.

Figure 1:
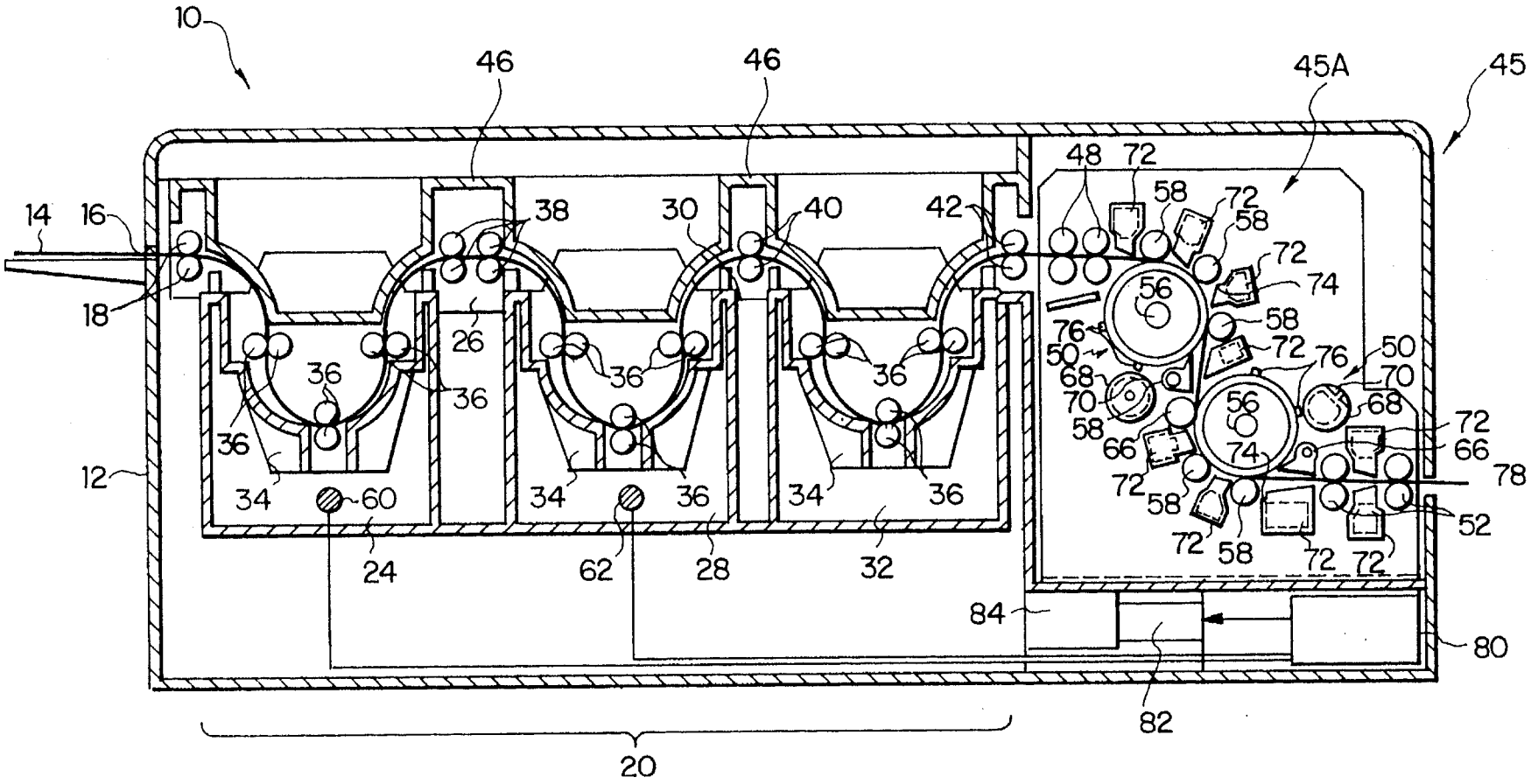
FIG. 1 is a schematic diagram showing the structure of an automatic developing machine which may be an apparatus for processing photographic materials.

Therein, the numeral 10 represents an automatic developing machine, the numeral 14 a photographic material, the numeral 45 a drying operation unit (a drying installation for photographic materials), the numeral 50 hot rollers (the first and the second ones), the numeral 56 heat sources, the numeral 68 blowing pipes, the numerals 70 and 74 slits, the numeral 82 fans (drying-air supplying means), the numeral 84 a heater (drying-air supplying means), the numeral 86 the body of the guide (chamber), and the numeral 100 a sensor for detecting the surrounding temperature and humidity.

DETAILED DESCRIPTION OF THE INVENTION

FIG. 1 diagrams schematically the structure of an automatic developing machine 10 which is an apparatus for processing photographic materials according to the present invention.

The casing 12 of the automatic developing machine 10 has an inlet 16 for inserting therein a photographic material 14 on the left side of FIG. 1 (at the starting point on the upstream side of the processing operation). On the inside of the inlet 16, there is installed a pair of rollers 18 designed so as to revolve using a driving means which is not drawn in the figure. Accordingly, the photographic material 14 inserted into the inlet 16 is conducted to the processing operation part 20 installed in the interior of the automatic developing machine 10 by means of the driving force of the roller pair 18.

In the processing operation part 20, a developing tank 24, a rinsing tank 26, a fixing tank 28, a rinsing tank 30 and a washing tank 32 are arranged in this order, starting from the left side of FIG. 1. The developing tank 24, the fixing tank 26 and the washing tank 32 (which are called "processing tanks" collectively, if needed hereinafter) have a developer, a fixer and washing water respectively in reserve. On the other hand, the rinsing tank 26 is fed with rinsing water (e.g., water or an aqueous solution of acetic acid), and the rinsing tank 30 is also fed with rinsing water (e.g., water). These rinsing waters are piped into the rinsing tanks respectively from their respective saving tanks via individual pumps, though these attachments are not illustrated in the figure, and the rinsing compartments are designed so that surplus rinsing solutions may overflow the rinsing tanks 26 and 30 respectively into their individual overflow tanks, which are not shown in the figure, either. In case the rinsing solutions are water, each of the rinsing tanks 26 and 30 may be designed so as to be equipped with a conduit pipe attached to a faucet via a solenoid valve. Therein, service water is fed directly to each tank without using any saving tank.

In each of the processing tanks 24, 28 and 32, a rack 34 equipped with multiple pairs of rollers 36 are installed. The photographic material 14 is held between each pair of rollers 36 and transported by these rollers along a definite transporting course. In the upper part of each processing tank, a crossover rack 46 equipped with a rinse rack is disposed. The crossover rack 46 is provided with pairs of rollers 38 and 40 in the upper parts of the rinsing tanks 26 and 30 respectively. These rollers not only hold the photographic material 14 and guide it to a neighboring processing tank, but also remove the processing solution adsorbed onto the photographic material 14.

In the developing tank 24 and the fixing tank 28, heaters 60 and 62 are disposed respectively. Each heater is constituted of a cylinder made of a stainless steel alloy (e.g., SUS316) and a coils-form heater itself admitted therein as a heat source (the illustration of which is omitted), and inserted into the given processing tank from the side wall thereof. The developer and the fixer are heated by those heaters 60 and 62 respectively so that their temperature may be raised up to the temperature at which photographic processing of the photographic material 14 becomes possible at the start of the processing operation of the automatic developing machine 10, whereas after the start of the processing operation the photographic material 14 may be maintained at the temperature which permits the processing of the photographic material.

The photographic material 14 having been washed in the washing tank 32 is transported into a drying operation part 45, which neighbors with a processing operation part 20, by a pair of transporting rollers 42. In the drying operation part 45, there are taken drying steps of the photographic material 14 which has finished the washing step with washing water.

Figure 2:
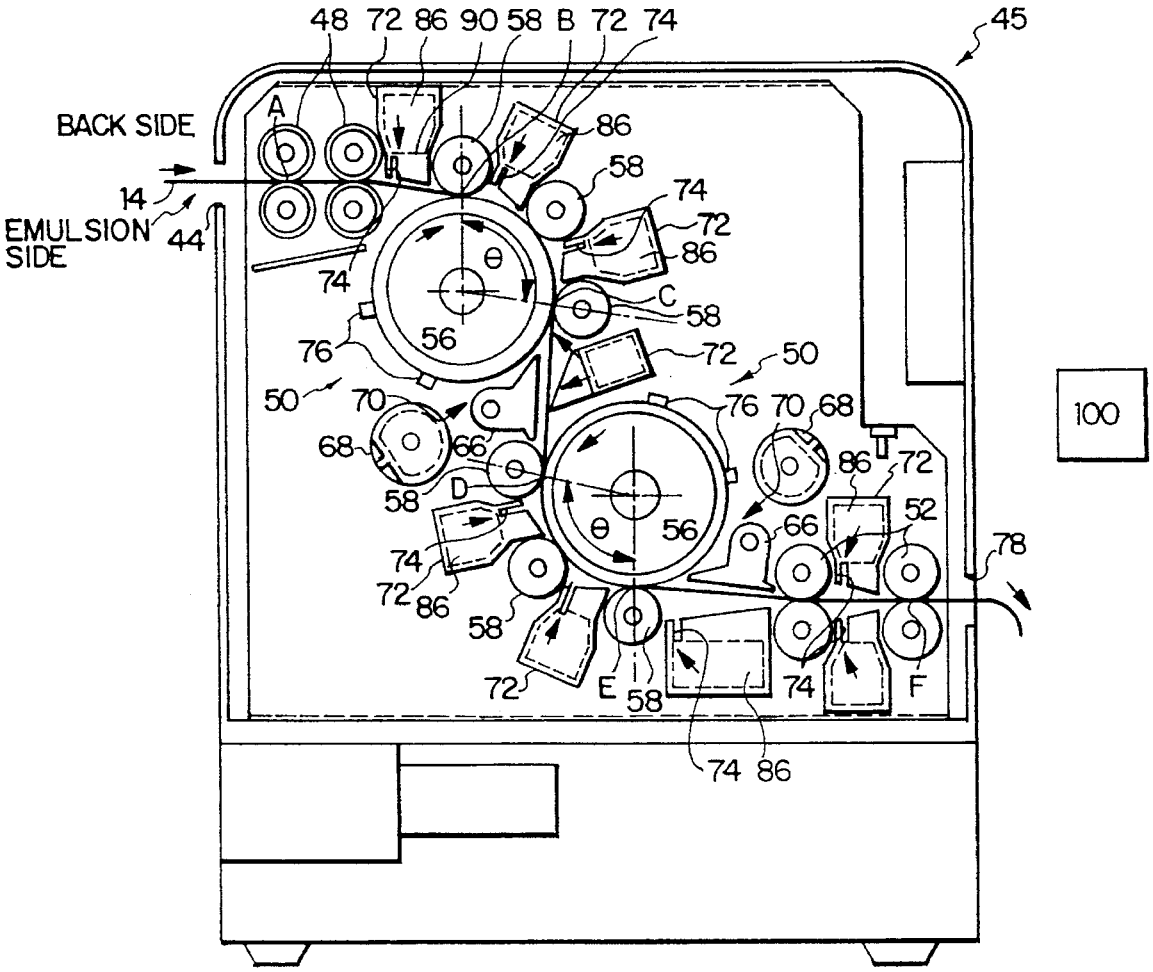
FIG. 2 is a diagram showing the structure of the drying operation unit of the automatic developing machine.

As illustrated in FIG. 2, the photographic material 14 is introduced into a drying room 45A of the drying operation part 45 via an insertion inlet 44. In the drying room 45A, pairs of squeeze rollers 48, two hot rollers 50 and 50 and pairs of discharge rollers 52 are disposed along the transporting course of the inserted photographic material 14. These rollers each are laid between a pair of side boards and both ends of their individual pivots are supported by the side boards respectively. A driving force generated by a driving means, which is not drawn in the figure, is transmitted to these pairs of squeeze rollers 48, hot rollers 50 and pairs of discharge rollers 52 to make the photographic material 14 travel at a constant speed.

The water adhering to the surface of the photographic material 14 is squeezed while the photographic material is being held between each pair of squeeze rollers 48 and is moved forward thereby. Further, the guide 74 disposed on the downstream side of the squeeze rollers guides the photographic material 14 to the periphery of one of the hot rollers 50.

The two hot rollers 50 are arranged in almost vertical directions, and each of them makes the photographic material 14 move forward so that the peripheral faces thereof may be wrapped in the photographic material.

As shown in FIG. 2, the angle of wrapping of the photographic material 14 around the hot roller 50, or the angle θ determined by the starting point of the wrapping (the point B and the point D in FIG. 2) and the end point of the wrapping (the point C and the point E in FIG. 2), is approximately 90°.

This angle θ is set on the basis of the outside diameter and the revolving speed (transporting speed of the photographic material) of the hot roller 50 so as to secure an intended contact duration between the hot roller and the photographic material. Moreover, the quantity of heat applied to the photographic material 14 depends on this contact duration and the peripheral temperature of the hot roller 50. Accordingly, if the angle θ is set at around 90°, as shown in FIG. 2, in the present examples, a proper heating treatment can be effected by setting the peripheral temperature of the hot roller at 70° C.

Each of these hot rollers 50 has a cylindrical form, and in the pivotal part thereof there is disposed a heat source 56 for heating the peripheral part of each hot roller, which is constituted of concentrically arranged halogen lamps or the like. This heat source 56 undertakes the heating of the periphery of the hot roller 50.

On the periphery of the hot roller 50 are disposed two or more nip rollers 58, and the photographic material 14 wrapped around the hot roller 50 is held between each nip roller and the peripheral face of the hot roller. The photographic material 14 is brought into contact with the peripheral face of the hot roller heated by the heat source 56, and heated through conduction of heat thereto from the hot roller.

Beside each hot roller 50 on the downstream side of the transporting direction of the photographic material 14, there is disposed a release guide 66 one end of which is in contact with the periphery of the hot roller and the other end of which has a pivot supported by a pair of side boards not shown. This release guide enables the photographic material 14 wrapped around the hot roller 50 to be released from the periphery of the hot roller 50 at a definite position. In addition, the middle part of the release guide 66 projects out toward the downstream of the transporting direction of the photographic material 14, so that it can guide the photographic material released from the hot roller 50 to the downstream direction of the transportation.

There are disposed guides 72 over each hot roller 50 on the downstream side thereof and between the discharge rollers 52. The photographic material 14 sent out by the squeeze rollers 48, the hot rollers 50 or the discharge rollers 52 is guided toward the downstream of the transportation by the guides 72.

The main body 86 of the guide 72 is a tube having an almost rectangular sectional shape, which is opened at one end and closed at the other end in the length direction, and forms a chamber. Each of the guides 72 is disposed so that the length direction of its main body may correspond to the width direction of the photographic material 14 (perpendicular to the paper in FIG. 2), and fixed on the side boards (an illustration of which is omitted). The main body of the guide has ribs 90 arranged parallel to the transport direction at the surface on the side of the transport course of the photographic material 14, and further has slits 74 along the length direction of the main body of the guide (the width direction of the photographic material).

Inside the drying room 45A, as shown in FIG. 2, the blowing pipe 68 the interior of which is hollow is installed on the opposite side of each hot roller 50, around which the photographic material is not wrapped. Each blowing pipe 68 has a slit 70 formed along the width direction of the photographic material 14, which is connected to the inside. The blowing pipes 68 each are fed with drying air similarly to the above-described guides 72 by a drying air-supplying means.

Accordingly, the drying air fed to the blowing pipes 68 and guides 72 is blown from the slits 70 and 74 toward the face of the photographic material 14. This drying air expels the air containing much moisture covering the vicinity of the surface of the photographic material 14 heated by the hot roller 50.

In the lower part of the drying room 45A, there are installed a fan 82 and a heater 84 as a drying air supplying means. The drying air generated therefrom is distributed among the above-described blowing pipes 68 and the main body 86 of the guides 72 via ducts which are not drawn in the figure.

Outside the automatic developing machine 10, there is disposed a surroundings temperature-and-humidity detecting sensor 100. The detecting center 100 is designed so as to detect the temperature and the humidity of the surroundings in which the machine 10 is placed, and so as to control the temperature of the hot rollers on the basis of the obtained data concerning temperature and humidity.

Inside the drying room 45A, temperature sensors 76 are arranged in the vicinity of the peripheral part of each hot roller 50. The peripheral face temperature of each hot roller 50, that is, the heating temperature of the photographic material 14, is measured with these temperature sensors 76.

The photographic material 14 having finished the drying processing in the drying room 45A is discharged from an outlet 78 to the exterior of the automatic developing machine 10.

The hydrophobic polymer layer of the present invention is described below in detail.

The hydrophobic polymer layer of the present invention does not swell in processing solutions in a substantial sense. The expression "does not swell in processing solutions in a substantial sense" signifies that the thickness of the polymer layer after the conclusion of the washing step in the development process is at most 1.05 times that of the polymer layer after the conclusion of the drying step.

The hydrophobic polymer layer of the present invention is not particularly restricted as to its binder, provided that the combination of the polymer layer with backing layers "does not swell in processing solutions in a substantial sense."

Specific examples of a binder which can be used for the hydrophobic polymer layer include polyethylene, polypropylene, polystyrene, polyvinyl chloride, polyvinylidene chloride, polyacrylonitrile, polyvinyl acetate, urethane resins, urea resins, melamine resins, phenol resins, epoxy resins, fluorine-containing resins such as polytetrafluoroethylene, polyvinylidene fluoride, etc., rubbers such as butadiene rubber, chloroprene rubber, natural rubber, etc., acrylic or methacrylic acid esters such as polymethylmethacrylate, polyethylacrylate, etc., polyester resins such as polyethylene phthalate, etc., polyamide resins such as nylon 6, nylon 66, etc., cellulose resins such as cellulose triacetate, etc., water-insoluble polymers such as silicone resins, and derivatives thereof.

Additionally, the binder of the hydrophobic polymer layer may be either a homopolymer constituted of monomers of the same kind or a copolymer constituted of monomers of at least two different kinds.

The homopolymers and copolymers cited above may be used alone or as a mixture of two or more thereof.

The hydrophobic polymer layer of the present invention may optionally contain photographic additives such as a matting agent, a surfactant, dyes, a slipping agent, a cross-linking agent, a thickener, a UV absorber, inorganic fine particles such as colloidal silica, and so on.

For details of these additives *Research Disclosure*, volume 176, Item 17643 (December 1978) can be referred to.

The hydrophobic polymer layer of the present invention may be a single layer, or it may be two or more layers.

The hydrophobic polymer layer has no particular limitation on thickness. However, when a light-insensitive hydrophilic colloid layer is present underneath the hydrophobic polymer layer, too small a thickness of the polymer layer is inadequate because it results in an insufficient water resisting property of the polymer layer, which results in swelling of the backing layer in the processing solutions. On the other hand, too great a thickness of the polymer layer results in an insufficient water vapor permeability of the polymer layer, which inhibits moisture from being absorbed by or desorbed from the hydrophilic colloid layer provided as a backing layer, causing a poor anti-curling condition. Of course, the thickness of the hydrophobic polymer layer depends on the physical properties of the binder used therein. In determining the thickness of the polymer layer, therefore, it is necessary to take into account the above-described factors. Specifically, a suitable thickness of the polymer layer, though it depends on the species of the binder used therein, ranges from 0.05 to 10 μm, preferably from 0.1 to 5 μm.

Additionally, when the hydrophobic polymer layer of the present invention is two or more layers, the total thickness of these layers is taken as the thickness of the polymer layer of the present silver halide photographic material.

The hydrophobic polymer layer of the present invention is not particularly restricted as to the coating method thereof.

The hydrophobic polymer layer may be coated on a backing layer and then dried, after the backing layer is coated and dried, or the polymer layer and the backing layer may be coated simultaneously, and then dried.

In coating the hydrophobic polymer layer, the ingredients for the polymer layer may be either dissolved in a solvent for the binder or converted into an aqueous dispersion.

In the second place, the light-insensitive hydrophilic colloid layer provided on the side opposite to the side of emulsion layers (called "the backing layer" herein) is described below in detail.

The backing layer of the present invention uses a hydrophilic colloid as a binder. As the hydrophilic colloid, those having a hygroscopic degree and a hygroscopic speed close to those of the binder used in photographic constituent layers disposed on the side having silver halide emulsion layers are desirable from the curling point of view. The hydrophilic colloid most preferred as the binder of the present backing layer is gelatin.

Any kind of gelatin which is generally used in the arts, including the so-called lime-processed gelatin, acid-processed gelatin, enzyme-processed gelatin, gelatin derivatives and denatured gelatin, may be used.

Of these kinds of gelatin, lime-processed gelatin and acid-processed gelatin are most preferably used.

Hydrophilic colloids other than gelatin, include proteins such as colloidal albumin, casein, etc., sugar derivatives such as agar, sodium alginate, starch derivatives, etc., cellulose compounds such as carboxymethyl cellulose, hydroxymethyl cellulose, etc., synthetic hydrophilic compounds such as polyvinyl alcohol, poly-N-vinylpyrrolidone, polyacrylamide, and so on.

The synthetic hydrophilic compounds may copolymerize with another constituent repeating unit. However, it is not appropriate from a curling point of view that the fraction of the hydrophobic comonomer is too high, because it brings on decreases in the quantity of moisture absorbed by the backing layer and in the hygroscopic speed of the backing layer.

These hydrophilic colloids may be used alone, or as a mixture of two or more thereof.

In addition to the binder, the present backing layer may contain various photographic additives including a matting agent, a surfactant, dyes, a cross-linking agent, a thickener, antiseptics, a UV absorber, inorganic fine particles such as colloidal silica, and so on.

For details of such photographic additives *Research Disclosure*, volume 176, Item 17643 (December 1978), for instance, can be referred to.

The present backing layer may further contain a polymer latex.

The polymer latex which may be used is an aqueous dispersion of water-insoluble polymer particles having an average size of 20 to 200 μm. A suitable ratio of the polymer latex to the binder ranges from 0.01:1.0 to 1.0:1.0, preferably from 0.1:1.0 to 0.8:1.0, by dry weight.

Suitable examples of a water-insoluble polymer which can constitute the polymer latex used in the present invention include polymers containing as a monomer unit an alkyl, hydroxyalkyl or glycidyl ester of acrylic acid or an alkyl, hydroxyalkyl or glycidyl ester of methacrylic acid and having an average molecular weight of at least 100,000, particularly preferably from 300,000 to 500,000.

Specific examples of such polymers are illustrated below:

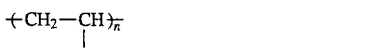

n = 3500 (Polymer 1)

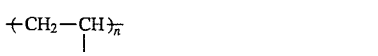

n = 3100 (Polymer 2)

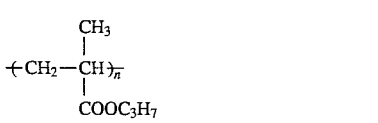

(Polymer 3)

n = 3000

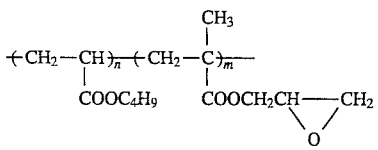

(Polymer 4)

n = 1700
m = 1000

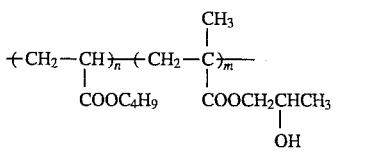

(Polymer 5)

n = 2100
m = 800

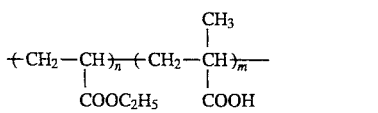

(Polymer 6)

n = 3500
m = 250

The backing layer of the present invention may be a monolayer or a multilayer. The thickness of the present backing layer, though it does not have any particular limits, ranges preferably from 0.2 to 20 μm, particularly from 0.5 to 10 μm, in view of curling.

When the backing layer is two or more layers, a total thickness of these backing layers is taken as the thickness of the backing layer of the present silver halide photographic material.

The backing layer of the present invention does not swell in a substantial sense in processing solutions.

The expression "does not swell in a substantial sense in processing solutions" means that the thickness of the backing layer after the conclusion of a washing step in photographic processing is at most 1.05 times the thickness thereof after the conclusion of a drying step.

The backing layer of the present invention intrinsically swells in processing solutions because it contains as a binder a hydrophilic colloid such as gelatin.

However, the present backing layer avoids swelling in a substantial sense in processing solutions by providing thereon a hydrophobic polymer layer (abbreviated as "a polymer layer" hereinafter).

The present backing layer has no particular restriction as to the coating method thereof.

In coating the present backing layer, there can be employed any known method which has been conventionally used for coating hydrophilic colloid layers of a silver halide photographic material. For instance, a dip coating method, an air-knife coating method, a curtain coating method, a roller coating method, a wire-bar bar coating method, a gravure coating method, an extrusion coating method using the hopper disclosed in U.S. Pat. No. 2,681,294, or the simultaneous multi-layer coating methods disclosed in U.S. Pat. Nos. 2,761,418, 3,508,947 and 2,761,791 can be adopted.

A light-insensitive hydrophilic colloid layer colored with dyes (abbreviated as "a dyed layer" ), which is provided on and/or underneath the emulsion layers in the present invention, is a layer provided for the purposes of antihalation, improvement in safelight immunity and clearer distinction between the front and the back surfaces of the photographic material.

In general the hydrophilic colloid layer to be colored contains a dye. It is necessary for such a dye to satisfy the following requirements:

(1) its spectral absorption is proper for the intended purpose;

(2) it is inert photochemically. That is, it does not have in a chemical sense any bad influence on the properties of the silver halide emulsion layers, such as lowering of sensitivity, fading latent images, generation of fog, and so on;

(3) it is decolored during the course of photographic processing, or eluted by a processing solution or washing water to leave no harmful influence on the photographic material after processing;

(4) it does not diffuse from the colored layer into the other layers; and (5) it has excellent storage stability in the form of a solution or in a condition that it is incorporated in a photographic material, so that it causes neither color change nor discoloration upon storage.

Examples of the dyeing methods which can satisfy these requirements include a method of causing a dye to be adsorbed by a mordant, as disclosed in U.S. Pat. Nos. 3,455,693, 2,548,564, 4,124,386 and 3,625,694, JP-A-47-13935 (the term "JP-A" as used herein means an "unexamined published Japanese patent application" ), JP-A-55-33172, JP-A-56-36414, JP-A-57-161853, JP-A-52-29727, JP-A-61-198148, JP-A-61-177447, JP-A-61-217039, etc.; a method of using a nondiffusible dye as disclosed in JP-A-61-213839, JP-A-63-208846, JP-A-63-296039, JP-A-01-158439, etc.; a method of dissolving a dye in an oil and emulsifying it to disperse in the form of oil droplets, as disclosed in JP-A-01-142688; a method of causing a dye to be adsorbed on to the surface of an inorganic material, as disclosed in U.S. Pat. Nos. 2,719,088, 2,496,841 and 2,496,843, JP-A-60-45237, JP-A-01-139691, etc.; a method of causing a dye to be adsorbed to a polymer, as disclosed in JP-A-01-119851; a method of using a water-insoluble solid dye, as disclosed in JP-A-56-12639, JP-A-55-155350, JP-A-55-155351, JP-A-63-27838, JP-A-63-197943, European Patents 15,601, 274,723, 276,566 and 299,435, WO 88/04794, JP-A-01-87367, JP-A-04-14035, JP-A-03-185773, etc.; and so on. Of these methods, the method of dispersing a dye in a solid condition is favored over others from the standpoint of preventing color stain from generating after photographic processing, and dye being fixed in a specific layer.

Typical examples of dyes which can meet the foregoing requirements are illustrated below:
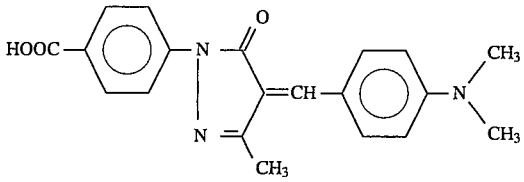
(S-1)
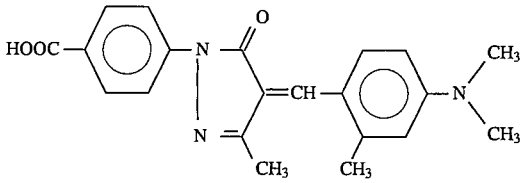
(S-2)
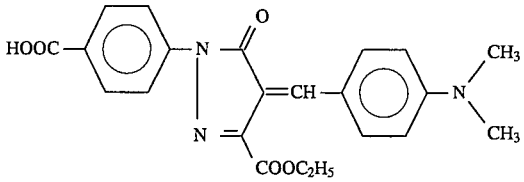
(S-3)
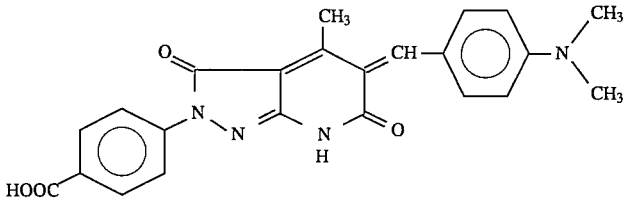
(S-4)
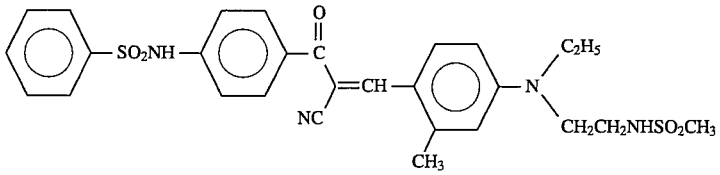
(S-5)
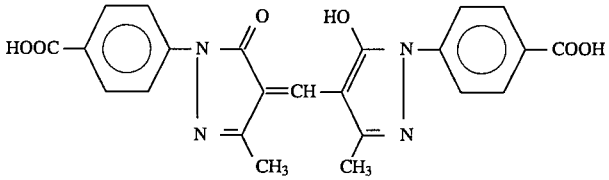
(S-6)
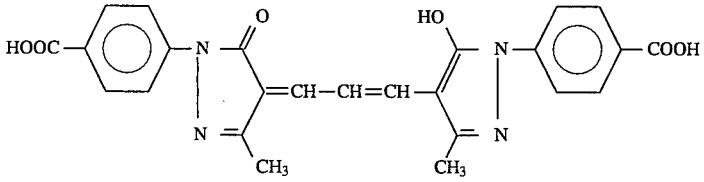
(S-7)
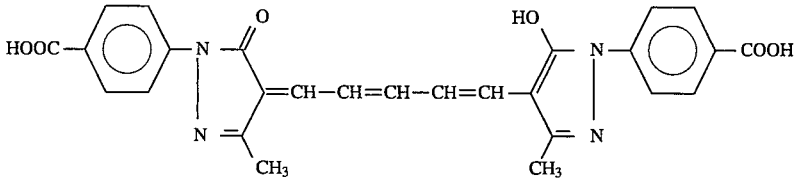
(S-8)

-continued
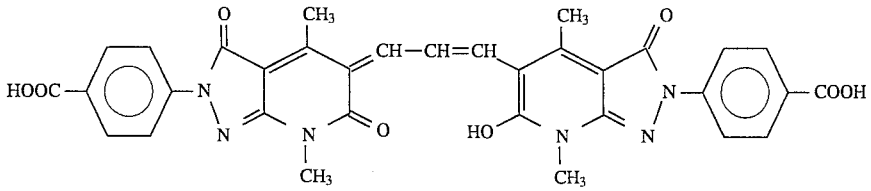
(S-9)
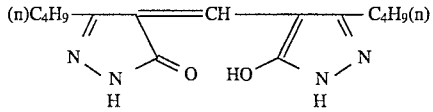
(S-10)
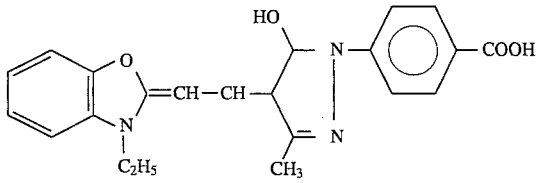
(S-11)
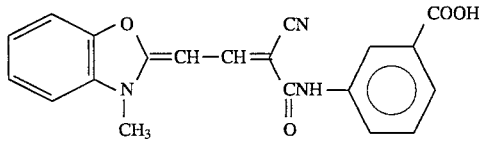
(S-12)
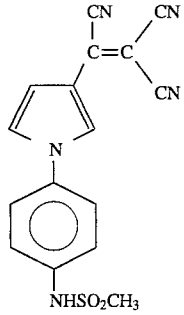
(S-13)
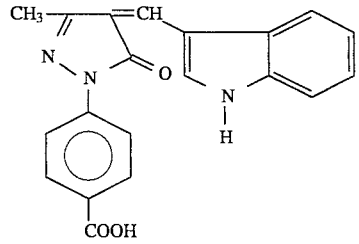
(S-14)
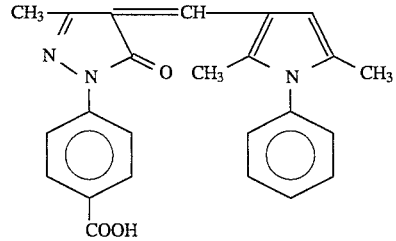
(S-15)

-continued
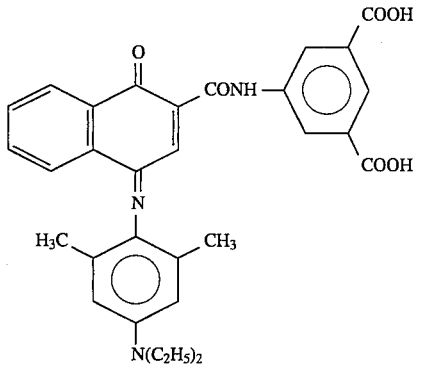
(S-16)
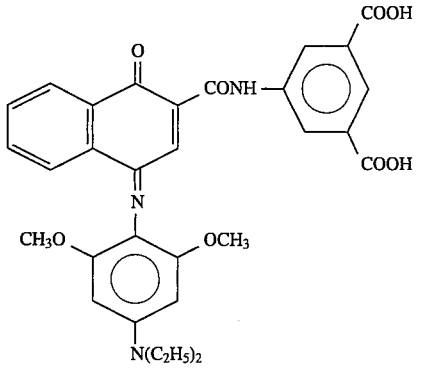
(S-17)
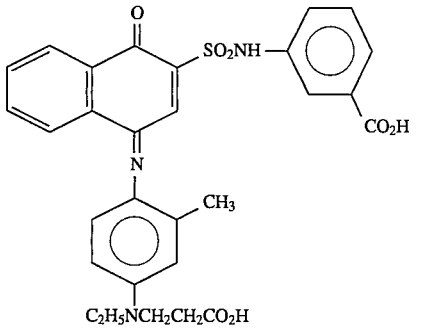
(S-18)
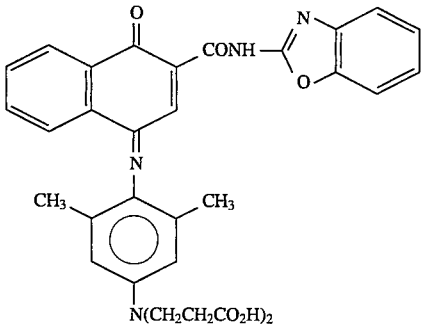
(S-19)

-continued
(S-20)
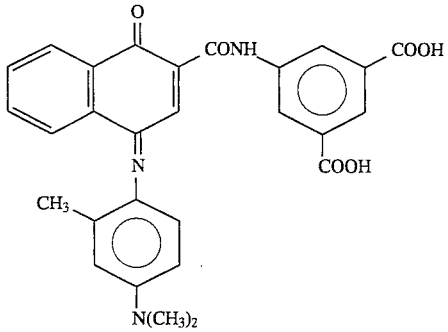
(S-21)
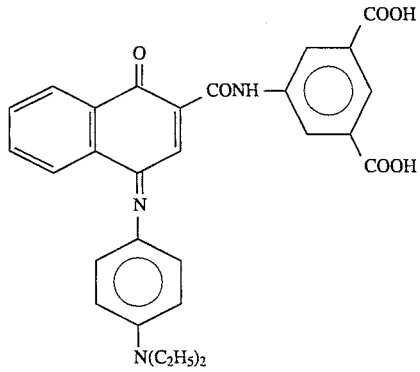
(S-22)
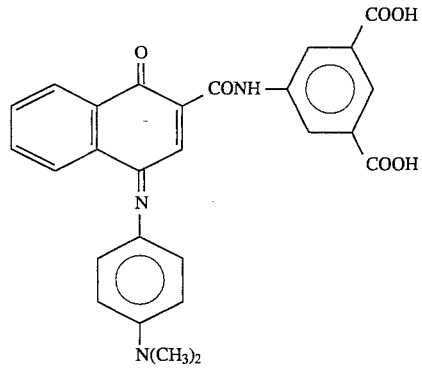
(S-23)
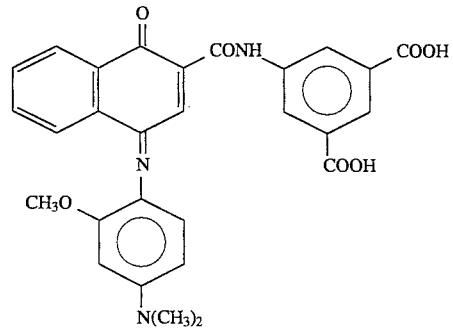
(S-24)
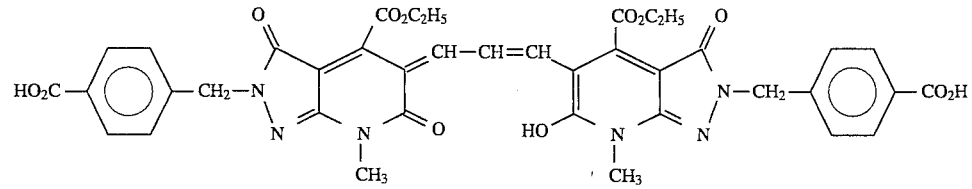

-continued
(S-25)
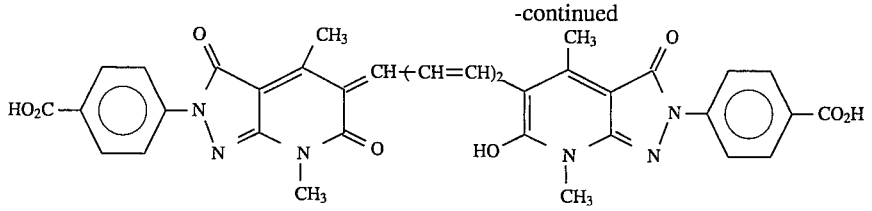
(S-26)
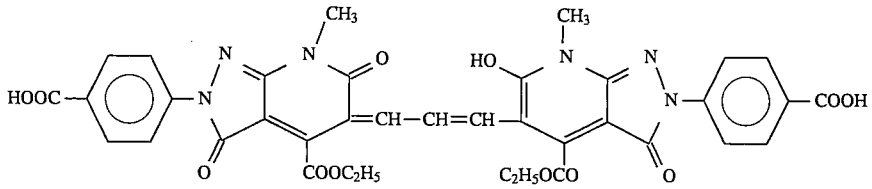
(S-27)
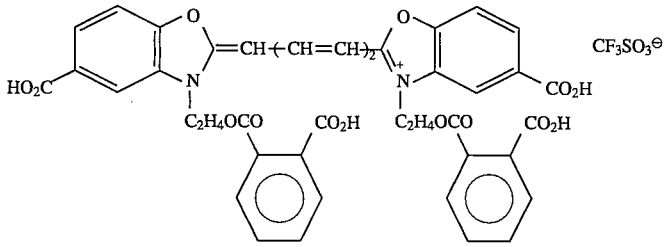
(S-28)
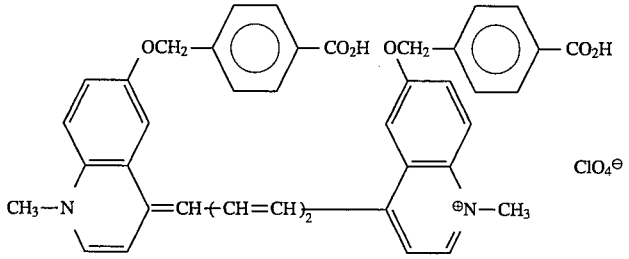
(S-29)
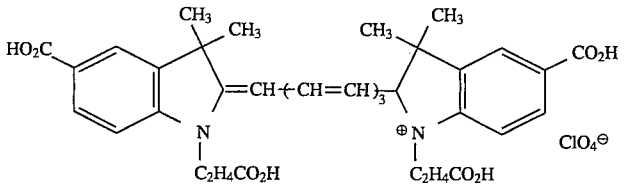
(S-30)
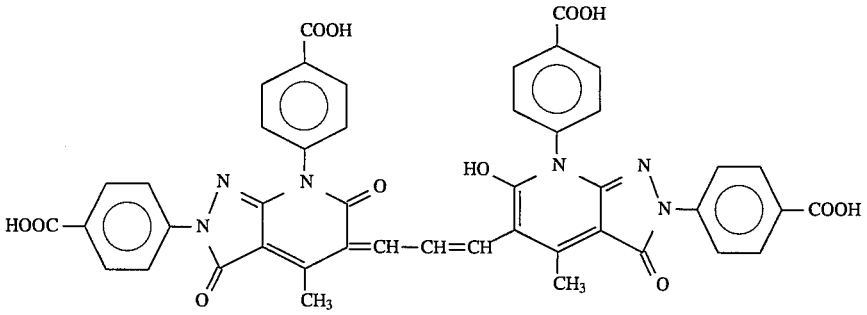
(S-31)
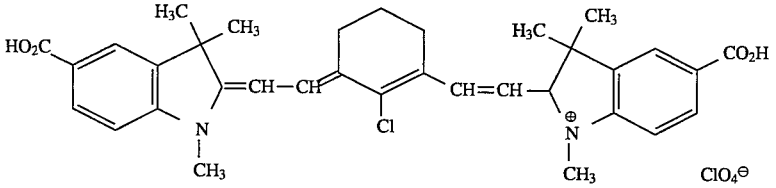

-continued
(S-32)
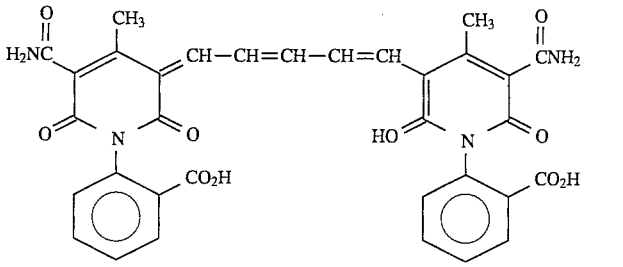
(S-33)
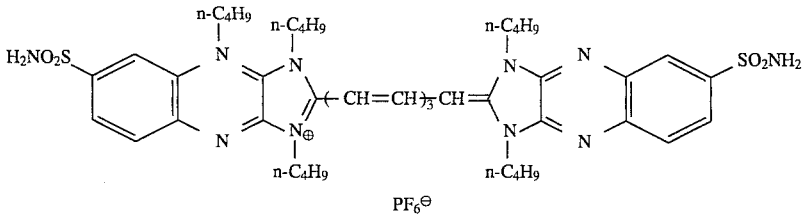
(S-34)
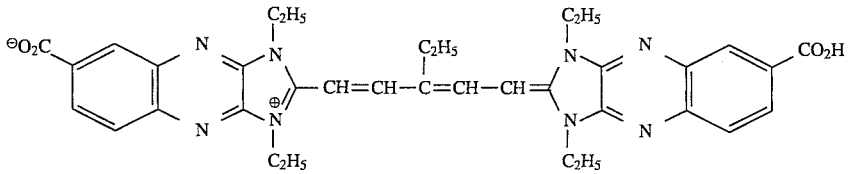
(S-35)
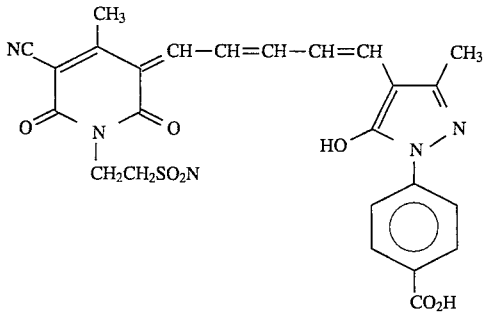
(S-36)
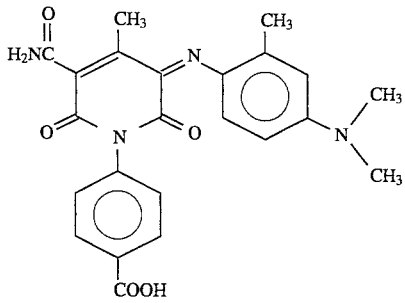
(S-37)
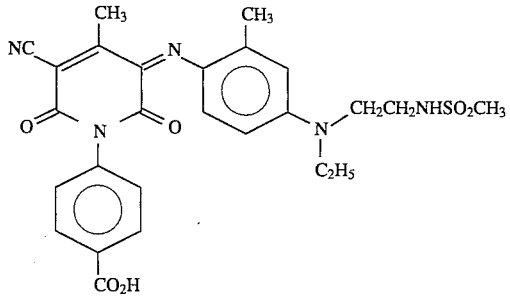

-continued

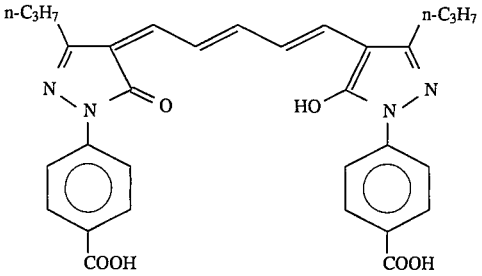

(S-38)

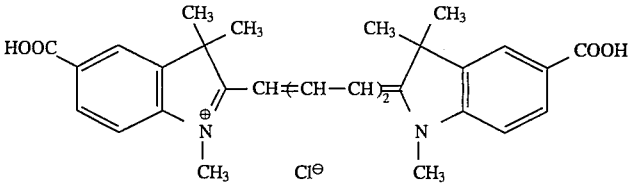

(S-39)

The present invention does not have any particular restriction as to the various kinds of additives used in the photographic material. For instance, the additives described in the passages of the references cited below can be preferably used.

| Items | References (corresponding passages) |
|---|---|
| 1) Silver halide emulsions and their preparation methods | JP-A-02-97937 (from 12th line in right lower column at page 20 to 14th line in left lower column at page 21), JP-A-02-12236 (from 19th line in right upper column at page 7 to 12th line in left lower column at page 8), and Japanese Patent Application Nos. 03-116573 and 03-189532. |
| 2) Spectral sensitizing dyes | JP-A-02-55349 (from 8th line in left upper column at page 7 to 8th line in right lower column at page 8), JP-A-02-39042 (from 8th line in right lower column at page 7 to 5th line in right lower column at page 13), JP-A-02-12236 (from 13th line in left lower column to 4th line in right lower column at page 8), JP-A-02-103536 (from 3rd line in right lower column at page 16 to 20th line in left lower column at page 17), and the spectral sensitizing dyes disclosed in JP-A-01-112235, JP-A-02-124560, JP-A-03-7928, and Japanese Patent Application Nos. 03-189532 and 03-411064. |
| 3) Surfactants, Antistatic agents | JP-A-02-12236 (from 7th line in right upper column to 7th line in right lower column), and JP-A-02-18542 (from 13th line in left lower column at page 2 to 18th line in right lower column at page 4). |
| 4) Antifoggants, Stabilizers | JP-A-02-103536 (from 19th line in right lower column at page 17 to 4th line in right upper column at page 18 and from 1st to 5th line in right lower column at page 18), and the thiosulfinic acid compounds disclosed in JP-A-01-237538. |
| 5) Polymer latexes | JP-A-02-103536 (from 12th line to 20th line in left lower column at page 18). |

-continued

| Items | References (corresponding passages) |
|---|---|
| 6) Compounds having acidic groups | JP-A-02-103536 (from 6th line in right lower column at page 18 to 1st line in left upper column at page 19), and JP-A-02-55349 (from 13th line in right lower column at page 8 to 8th line in left upper column at page 11). |
| 7) Polyhydroxybenzenes | JP-A-02-55349 (from 9th line in left upper column to 17th line in right lower column at page 11). |
| 8) Matting agents, Lubricants, Plasticizers | JP-A-02-103536 (from 15th line in left upper column to 15th line in right upper column at page 19). |
| 9) Hardeners | JP-A-02-103536 (from 5th line to 17th line in right upper column at page 18). |
| 10) Dyes | JP-A-02-103536 (from 1st line to 18th line in right lower column at page 17), and JP-A-02-39042 (from 1st line in right upper column at page 4 to 5th line in right upper column at page 6). |
| 11) Binders | JP-A-02-18542 (from 1st line to 20th line in right lower column at page 3). |
| 12) Developers and developing methods | JP-A-02-55349 (from 1st line in right lower column at page 13 to 10th line in left upper column at page 16), and JP-A-02-103536 (from 16th line in right upper column at page 19 to 8th line in left upper column at page 21). |
| 13) Black spots inhibitors | The compounds disclosed in U.S. Pat. No. 4,956,257 and JP-A-01-118832. |
| 14) Redox compounds | The compounds represented by general formula (I) of JP-A-02-301743, especially Compounds 1 to 50; the compounds represented by general formulae (R-1), (R-2) and (R-3), specifically Compounds 1 to 75, disclosed in JP-A-03-174143, at pages 3 to 20; and the compounds disclosed in JP-A-03-69466 and JP-A-03-15648. |
| 15) Monomethine compounds | The compounds represented by general formula (II) of JP-A-02-287532, especially Compounds II-1 to II-26. |

-continued

| Items | References (corresponding passages) |
|---|---|
| 16) Hydrazine nucleation agents | JP-A-02-12236 (from 19th line in right upper column at page 2 to 3rd line in right upper column at page 7), and the compounds represented by general formula (II) of JP-A-03-174143, with examples including Compounds II-1 to II-54, illustrated from 1st line in right lower column at page 20 to 20th line in right upper column at page 27. |
| 17) Nucleation accelerators | The compounds represented by general formulae (II-m) to (II-p) of JP-A-02-103536, with examples including Compounds II-1 to II-22, illustrated from 13th line in right upper column at page 9 to 10th line in left upper column at page 16; and the compounds disclosed in JP-A-01-179939. |

The automatic developing apparatus used in the present invention is described below.

The drying operation part of the automatic developing apparatus used in the present invention is a drying installation for drying a photographic material which is kept traveling along the transporting course. It is characterized by a design in which at least two hot rollers which each have a peripheral part heated with a heat source are arranged so that the photographic material wraps partly around each of the hot rollers in turn and the contact between the hot rollers and the material may alternate between the front surface and the back surface of the photographic material. Heating of the photographic material is carried out using heat, the quantity of which is determined on the basis of a peripheral temperature of each hot roller and the duration of the contact between the photographic material and each hot roller. The moisture in the photographic material evaporates from the surface areas which are not in contact with the hot rollers.

Further, it is possible to blow drying air upon the photographic material on the side of the material which is not in contact with a hot roller for the purpose of promoting evaporation of moisture.

The peripheral temperature of each hot roller is 80° C. at the highest, and the duration of the contact between each hot roller and the photographic material ranges from 1.5 to 5 seconds.

More specifically, the drying installation of the present invention is an installation for drying a photographic material which is kept traveling along the transporting course. The installation comprises a first hot roller which has a heating source on the inside, and part of the periphery on which is wrapped a photographic material so that it may contact with one side (e.g., the emulsion side) of the photographic material; a second hot roller which has a heating source on the inside, and part of the periphery on which is wrapped in the photographic material so that it may contact with the other side (e.g., the backing side) of the photographic material; two groups of chambers arranged in the width direction of the photographic material which is kept traveling as it is wrapped partly around each of the first and the second heating rollers in turn, one group of chambers facing the other side (e.g., the backing side) of the photographic material in the transportation area of the first hot roller, and the other group facing the one side (e.g., the emulsion side) of the photographic material in the transportation area of the second hot roller, and every chamber having a slit running so as to connect the inside thereof with the vicinity of the transporting course; and drying air-supplying means installed inside each chamber.

The peripheral temperature of the hot rollers and/or the temperature of the drying air which blows on the photographic material on the side of the material which is not in contact with the hot roller are/is set on the basis of the temperature and the humidity of an atmosphere in which the automatic developing apparatus is placed, so that the drying can be effected using hot rollers and/or drying air set at the minimum temperature.

When the drying installation of the present invention is used, the quantity of heat applied to a photographic material by each hot roller can be obtained as a function of the peripheral temperature of the hot roller and the duration of the contact between the hot roller and the photographic material. More specifically, since the drying power is determined by the product of the face temperature of each hot roller and the contact duration, a satisfactory drying result can be obtained by increasing the wrapped area of each hot roller to prolong the contact without reducing the transporting speed, even when the peripheral temperature of each hot roller is lowered. Accordingly, even when a paper or film jam occurs by accident to cause a tie-up in the neighborhood of a hot roller, overdrying can be prevented, because a low peripheral temperature of each hot roller prevents damage to the photographic material, such as the generation of wrinkles in the surface of the photographic material and deformation of the photographic material. Moreover, the heating of one side of the photographic material with the hot roller induces evaporation of the contained water from the other side of the photographic material. At this time, blowing of drying air on the other side of the photographic material can promote the evaporation of the contained water to result in shortening of a drying time.

In the drying installation of the present invention, the duration of the contact between a photographic material and each hot roller is short, or in a range of 1.5 to 5 seconds, so that the drying operation as a whole can be completed in 6 to 20 seconds. In addition, the surface of peripheral temperature of each hot roller can be controlled to 80° C. or lower so that the image quality is not damaged by the drying operation and high dimensional stability can be secured.

In the drying installation of the present invention, the emulsion side of a photographic material is heated by the first hot roller. As a result, the evaporation on the back side of the photographic material commences, and is promoted by drying air supplied to the chambers with a drying air supplying means.

Further, the back side of the photographic material is heated by the second hot roller, and thereby evaporation on the emulsion side is initiated. In order to promote the evaporation, drying air is also used herein.

Since the photographic material is wrapped around part of the first hot roller and part of the second hot roller, the heating duration depends on the wrapped area. Accordingly, compensation for a decrease in heating energy which is caused by lowering the surface temperature of the first and the second hot rollers can be made by prolonging of the heating duration (or the duration of the contact of the photographic material with the first and the second hot rollers), thereby achieving a proper heating operation.

Thus, even when the photographic material jams up as it is in contact with the first or/and the second hot rollers, the surfaces thereof do not acquire any wrinkles or the like resulting from local heating, so that the quality of the photographic material can be maintained.

Moreover, the face temperature of the first and the second hot rollers (80° C. at the highest) is much lower than that of conventional hot rollers of the type which hold a photographic material in pairs and transport it linearly (100°to 150° C.), so that the safety of the operator in maintenance working is not impaired, but can be improved.

The present invention will now be described in detail by way of the following examples. However, the invention should not be construed as being limited to these examples.

EXAMPLE 1

On one side of a 100 μm-thick polyethylene terephthalate support having a subbing layer on both sides, a backing layer and a polymer layer having the following compositions respectively were coated simultaneously, and dried for 5 minutes at 180° C. The backing layer was closer to the support than the polymer layer.

(1) Formula of Backing Layer:

| | |
|---|---|
| Gelatin | 3.0 g/m$^2$ |
| Fine particles of polymethylmethacrylate (average particle size: 3 μm) | 50 mg/m$^2$ |
| Sodium dodecylbenzenesulfonate | 10 mg/m$^2$ |
| Sodium polystyrenesulfonate | 20 mg/m$^2$ |
| N,N'-ethylenebis-(vinylsulfonacetamide) | 40 mg/m$^2$ |
| Ethylacrylate latex (average particle size: 0.1 μm) | 1.0 g/m$^2$ |

(2) Formula of Polymer Layer:

| | |
|---|---|
| Binder (See Table-1) | See Table-1 |
| Fine particles of polymethylmethacrylate (average particle size: 3 μm) | 10 mg/m$^2$ |
| $C_8F_{17}SO_3K$ | 5 mg/m$^2$ |

(As the solvent for these coating compositions, distilled water was used.)

Then, on the other side of the support were coated simultaneously a dye layer (3), an emulsion layer (4), a lower protective layer (5) and an upper protective layer (6) in this order. The compositions of these layers are described below.

-continued (3) Dye layer:

| | |
|---|---|
| Gelatin | 1.0 g/m$^2$ |
| *Compound Example, Dye S-10 | 0.075 g/m$^2$ |
| *Compound Example, Dye S-8 | 0.070 g/m$^2$ |
| Phosphoric acid | 0.015 g/m$^2$ |
| Sodium dodecylbenzenesulfonate | 0.015 g/m$^2$ |
| Sodium polystyrenesulfonate | 0.025 g/m$^2$ |
| 1,1'-Bis(vinylsulfonyl)methane | 0.030 g/m$^2$ |

<Preparation of Fine-Particle Dispersions of *Compound Examples Dye S-10 and Dye S-8>

The fine-particle dispersions of the present invention were each prepared in accordance with the method described in JP-A-63-197943.

More specifically, water (434 ml) and a 6.7% aqueous solution of a surfactant Triton™ X-200 R (sold by Rohm & Haas Co.) (53 g) were put in a 1.5 liter bottle with a screw top. Thereto, 20 g of each dye and zirconium oxide ($ZrO_2$) beads (having a diameter of 2 mm) (800 ml) were further added. Then, the screw top was screwed on the bottle, and the bottle was placed in a mill. Therein, the contents of the bottle were ground for 4 days.

The resulting contents was added to a 12.5% aqueous gelatin solution (160 g), and allowed to stand in a roll mill for 10 minutes to reduce the foam. The $ZrO_2$ beads were removed from the obtained mixture by filtration. As the filtrate contained fine particles having an average size of about 0.3 μm, it was subjected to centrifugal filtration to obtain a fraction in which the maximum size of particles was not greater than 1 μm.

(Dye S-8)

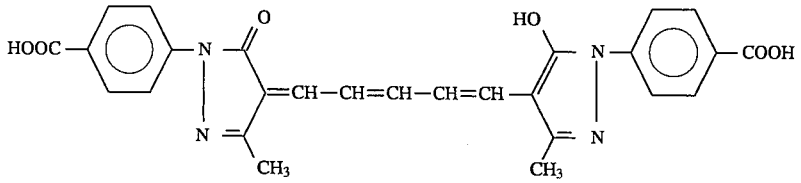

(Dye S-10)

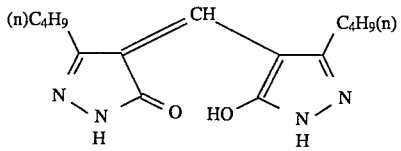

(4) Emulsion Layer:

<Preparation of Emulsion>

Solution I:

| | |
|---|---|
| Water | 1,000 ml |
| Gelatin | 20 g |
| Sodium Chloride | 20 g |
| 1,3-Dimethylimidazolidine-2-thione | 20 mg |
| Sodium Benzenesulfonate | 6 mg |

Solution II:

| | |
|---|---|
| Water | 400 ml |
| Silver Nitrate | 100 g |

-continued (Dye S-8)

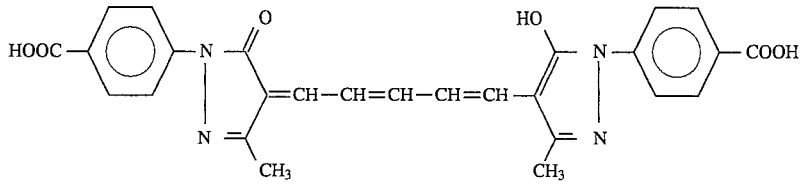

(Dye S-10)

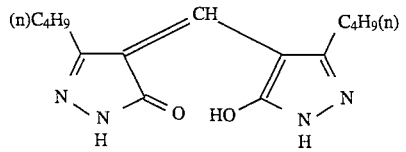

(4) Emulsion Layer:
<Preparation of Emulsion>

| | |
|---|---|
| Solution I: | |
| Solution III: | |
| Water | 400 ml |
| Sodium Chloride | 30.5 g |
| Potassium Bromide | 14 g |
| Potassium Hexachloroiridate(III) (0.001% aqueous solution) | 15 ml |
| Ammonium Hexabromorhodate(III) (0.001% aqueous solution) | 1.5 ml |
| Solution IV: | |
| Water | 400 ml |
| Silver Nitrate | 100 g |
| Solution V: | |
| Water | 400 ml |
| Sodium Chloride | 30.5 g |
| Potassium Bromide | 14 g |
| $K_4Fe(CN)_6$ | $1 \times 10^{-5}$ mole/mole Ag |

To Solution I which was maintained at 38° C. and pH 4.5, Solutions II and III were simultaneously added over a 10-minute period with stirring, thereby forming a grain core measuring 0.16 μm in size. Thereto, Solutions IV and V were further added over a 10-minute period, thereby forming a grain shell. Furthermore, 0.15 g of potassium iodide was admixed therewith to complete the grain formation.

The thus obtained emulsion was washed with water in a conventional manner, specifically using a flocculation method, and then 40 g of gelatin was added thereto.

The resulting emulsion was adjusted to pH 5.3 and pAg 7.5, and thereto were added 5.2 g of sodium thiosulfate, 10.0 mg of chloroauric acid and 2.0 mg of N,N-dimethylselenourea, which was further admixed with 2.0 mg of sodium benzenesulfonate and 2.0 mg of sodium benzenesulfinate. The chemical sensitization by the addition of these compounds was carried out so as to achieve maximum sensitivity at 55° C. Thus, a silver chlorobromide cubic grain emulsion having a chloride content of 80 mole % and an average grain size of 0.20 μm was obtained.

To the thus obtained emulsion, there were added $5\times10^{-4}$ mole/mole Ag of Sensitizing Dye (1) illustrated below to achieve orthochromatic sensitization. To the thus sensitized emulsion, there were further added hydroquinone and 1-phenyl-5-mercaptotetrazole in amounts of 2.5 g and 50 mg respectively per mole of Ag, colloidal silica (Snowtex™ C, produced by Nissan Chemicals Industries Ltd., with an average particle size of 0.015 μm) in a proportion of 30 wt % to gelatin, a polyethylacrylate latex (0.05 μm) as a plasticizer in a proportion of 40 wt % to gelatin and 1,1'-bis(vinyl-sulfonyl)methane as a hardener at a coverage of 35 mg/m$^2$ per g of the whole gelatin so as to impart the swelling degree shown in Table-1 to the photographic material to be prepared herein.

The thus prepared emulsion was coated on the support so as to have a silver coverage of 3.0 g/m$^2$ and a gelatin coverage of 1.5 g/m$^2$.

Sensitizing Dye (1)

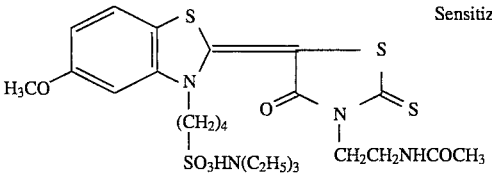

Sensitizing Dye (1)

In coating the emulsion, the upper and the lower protective layers having the individual compositions shown below were coated simultaneously.

| (5) Lower Protective Layer: | |
|---|---|
| Gelatin | 0.25 g/m$^2$ |
| Sodium benzenesulfonate | 4 mg/m$^2$ |
| 1,5-Dihydroxy-2-benzaldoxime | 25 mg/m$^2$ |
| Polyethylacrylate latex | 125 mg/m$^2$ |

-continued

| (6) Upper Protective Layer: | |
|---|---|
| Gelatin | 0.25 g/m$^2$ |
| Silica matting agent (average grain size: 2.5 μm) | 50 mg/m$^2$ |
| Compound (1) (gelatin dispersion of a slipping agent) | 30 mg/m$^2$ |
| Colloidal silica (Snowtex ™ C, products of Nissan Chemicals Industries Ltd.) | 30 mg/m$^2$ |
| Compound (2) | 5 mg/m$^2$ |
| Sodium dodecylbenzenesulfonate | 22 mg/m$^2$ |

All the kinematic friction coefficients of this sample were 0.22±0.03 ( 25° C.–60% RH, sapphire stylus ϕ=1 mm, load=100 g, speed=60 cm/min).

Compound (1)

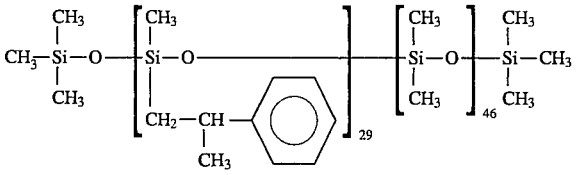

Compound (2)

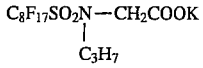

The thus obtained sample was allowed to stand for 1 week in an atmosphere of 25° C. and 60% RH, and examined for the following properties, thereby making evaluation of this sample.

(I) Swelling Degrees of Backing Layer and Polymer Layer in Processing Solutions:

(i) Thickness "d" Measurements of Backing and Polymer Layers Each after Conclusion of Washing Step;

The sample having finished the washing step of the following development processing was lyophilized with liquid nitrogen. The sample slices were observed under a scanning electron microscope, and thereby the thickness "d" of each of the backing layer and the polymer layer was determined.

(ii) Thickness "do" Measurements of Backing and Polymer Layers, Each after Drying Step;

The slices of the sample having finished the drying step of the following photographic processing were observed under a scanning electron microscope, and thereby the thickness "$d_0$" of each of the backing layer and the polymer layer was determined.

Swelling Percentage of Emulsion Layer Plus Protective Layers:

The total thickness of the emulsion and protective layers before swelling was measured under a sensing pressure of 30±5 g with an electron micrometer made by Anritsu Electric Co., Ltd., and that after swelling was measured under a sensing pressure of 2±0.5 g with the same electron micrometer.

(III) Drying Characteristics:

The sample of Dai-Zen size (51 cm×61 cm) was processed using an automatic developing apparatus illustrated below under the surrounding conditions of 27° C. and 70% RH, and examined for minimum drying time required for drying thoroughly the sample having just finished undergoing photographic processing.

In the automatic developing machine 10, there were used a developer and a fixer having the following compositions respectively, and their respective replenishment rates were 200 ml per m$^2$ of film.

| Composition of Developer (processing temperature: 38° C.): | |
|---|---|
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-hexahydro-2-thioxo-4-(1H)-quinazoline | 0.05 g |
| Sodium 2-mercaptobenzimidazole-5-sulfonate | 0.3 g |
| Water to make | 1 l |
| Potassium hydroxide to adjust | pH 10.7 |
| **Composition of Fixer (processing temperature: 38° C.):** | |
| Sodium thiosulfate | 160 g/l |
| 1,4,5-Trimethyl-1,2,5-triazolium-3-thiolate | 0.25 mole/l |
| Sodium hydrogen sulfite | 30 g/l |
| Disodium ethylenediaminetetra-acetate dihydrate | 0.025 g/l |
| Sodium hydroxide to adjust | pH 6.0 |

The results obtained are shown in Table-1. As can be seen from Table-1, the samples prepared in accordance with the present invention had excellent drying characteristics, that is, high suitability for rapid processing.

TABLE 1

| Sample No. | Backing Layer | Binder of Polymer Layer: Species of Polymer* | Binder of Polymer Layer: Thickness | $d/d_0$ of Backing Layer | $d/d_0$ of Polymer Layer | Swelling Percentage of Emulsion Layer plus Protective Layer | Drying Characteristics** |
|---|---|---|---|---|---|---|---|
| 1 | absent | P-1 | 1.0 μm | — | 1.00 | 150% | 10 seconds |
| 2 | present | P-1 | 1.0 μm | 1.00 | 1.00 | 150% | 10 seconds |
| 3 | absent | P-2 | 1.0 μm | — | 1.00 | 150% | 10 seconds |
| 4 | present | P-2 | 1.0 μm | 1.00 | 1.00 | 150% | 10 seconds |
| 5 | absent | P-3 | 1.0 μm | — | 1.00 | 150% | 10 seconds |
| 6 | present | P-3 | 1.0 μm | 1.00 | 1.00 | 150% | 10 seconds |
| 7 | present | — | — | 2.00 | — | 150% | 21 seconds |
| 1 | These samples each were processed using an automatic developing | | | | | | 25 seconds |
| 2 | machine, Model FG-710 NH (made by Fuji Photo Film Co., Ltd.) | | | | | | 25 seconds |

TABLE 1-continued

| Sample No. | Backing Layer | Binder of Polymer Layer: Species of Polymer* | Binder of Polymer Layer: Thickness | $d/d_0$ of Backing Layer | $d/d_0$ of Polymer Layer | Swelling Percentage of Emulsion Layer plus Protective Layer | Drying Characteristics** |
|---|---|---|---|---|---|---|---|
| 2 | ( under the condition that the temperature of drying air was 50° C. and the quantity of the drying air was 40 l/sec. ) | | | | | | 30 seconds |

*P-1; Polyolefin latex (Chemipearl-120, produced by Mitsui Petrochemical Industries, Ltd.)
P-2; Water urethane resin (HYDRAN AP60, produced by Dai-Nippon Ink & Chemicals, Inc.)
P-3; $(methylmethacrylate)_{62}$-$(styrene)_{8.5}$-$(2\text{-}ethylhexylacrylate)_{27}$-$(methacrylic\ acid)_{1.7}$
**Temperature of hot roller; 50° C.

EXAMPLE 2

Sample Nos. 5, 6 and 7, the same as those prepared in Example 1, were processed in the same manner as in Example 1, except that the surrounding conditions and the temperature of the hot rollers were changed as shown in Table-2, and examined for drying characteristics and dimensional change accompanied by photographic processing.

The dimensional change accompanied by photographic processing was determined as follows: two holes measuring 8 mm in diameter were made at an interval of 200 mm in each sample the whole surface of which had been exposed to light but had not yet undergone any photographic processing. The distance between these two holes was measured accurately with a pin gauge of a precision of 1/1000 mm, and represented by X (unit: mm). Then, the distance was measured again after each sample had undergone development, fixation, washing and drying operations using the present automatic developing machine and then had been allowed to stand for 5 minutes. The thus measured distance was represented by Y (unit: him).

The rate of the dimensional change (%) resulting from the photographic processing was evaluated by [(Y-X)/200]×100.

The results obtained are shown in Table-2. As can be seen from Table-2, the samples of the present invention exhibited excellent drying characteristics without suffering any deterioration of dimensional change resulting from the photographic processing.

TABLE 2

| Surroundings Condition | Sample No. | Temperature of Hot Roller | Drying Characteristics | Rate of Dimensional Change (%) |
|---|---|---|---|---|
| 25° C. 30% RH | 5 (invention) | 40° C. | 3 seconds | 0.001 |
| 25° C. 30% RH | 5 (invention) | 50° C. | 2.5 seconds | 0.002 |
| 25° C. 30% RH | 5 (invention) | 60° C. | 2 seconds | 0.003 |
| 25° C. 30% RH | 6 (invention) | 40° C. | 3 seconds | 0.001 |
| 25° C. 30% RH | 6 (invention) | 50° C. | 2.5 seconds | 0.002 |
| 25° C. 30% RH | 6 (invention) | 60° C. | 2 seconds | 0.003 |
| 25° C. 30% RH | 7 (comparison) | 40° C. | 13 seconds | 0.010 |
| 25° C. 30% RH | 7 (comparison) | 50° C. | 10 seconds | 0.012 |
| 25° C. 30% RH | 7 (comparison) | 60° C. | 8 seconds | 0.014 |
| 25° C. 60% RH | 5 (invention) | 40° C. | 4 seconds | 0.001 |
| 25° C. 60% RH | 5 (invention) | 50° C. | 3 seconds | 0.001 |
| 25° C. 60% RH | 5 (invention) | 60° C. | 2 seconds | 0.001 |
| 25° C. 60% RH | 6 (invention) | 40 C.° | 4 seconds | 0.001 |
| 25° C. 60% RH | 6 (invention) | 50° C. | 3 seconds | 0.001 |
| 25° C. 60% RH | 6 (invention) | 60° C. | 2 seconds | 0.001 |
| 25° C. 60% RH | 7 (comparison) | 40° C. | 20 seconds | 0.003 |
| 25° C. 60% RH | 7 (comparison) | 50° C. | 17 seconds | 0.004 |
| 25° C. 60% RH | 7 (comparison) | 60 C.° | 15 seconds | 0.007 |

EXAMPLE 3

After first and second subbing layers having the following compositions respectively were coated on both sides of a biaxially elongated polyethylene terephthalate support (thickness: 100 μm), a conductive layer having the following composition (surface resistibility: $2\times10^{10}$ Ω at 25° C. and 10% RH), the following backing layer and the following polymer layer were coated simultaneously on one side of the support.

| Composition of First Subbing Layer: | |
|---|---|
| Aqueous dispersion of copolymer of vinylidene chloride, methylmethacrylate, acrylonitrile and methacrylic acid (90:8:1:1 by weight) | 15 pts. wt. |
| 2,4-Dichloro-6-hydroxy-s-triazine | 0.25 pts. wt. |
| Fine particles of polystyrene (average particle size: 3 μm) | 0.05 pts. wt. |
| Compound-6 | 0.20 pts. wt. |
| Water to make | 100 pts. wt. |

To this composition was added 10 wt % KOH to adjust the pH to 6. The resulting composition was coated, and dried for 2 minutes at 180° C. to obtain a layer having a dry thickness of 0.9 μm.

| Composition of Second Subbing Layer: | |
|---|---|
| Gelatin | 1 pts. wt. |
| Methyl cellulose | 0.05 pts. wt. |
| Compound-7 | 0.02 pts. wt. |
| $C_{12}H_{25}O(CH_2CH_2O)_{10}H$ | 0.03 pt. wt. |
| Compound-8 | $3.5 \times 10^{-3}$ pt. wt. |
| Acetic acid | 0.2 pt. wt. |
| Water to make | 100 pts. wt. |

This composition was coated and dried at 170° C. for 2 minutes to form a layer having a dry thickness of 0.1 μm.

The solvent used in the above-described compositions was distilled water.

Then, on the other side of the support were coated simultaneously a colored layer, an emulsion layer, a lower protective layer and an upper protective layer in this order. The compositions of these layers are described below.

| Colored Layer: | |
|---|---|
| Gelatin | 1.5 g/m$^2$ |
| *Compound Example, Dye S-10 | 0.050 g/m$^2$ |
| *Compound Example, Dye S-16 | 0.070 g/m$^2$ |
| *Compound Example, Dye S-30 | 0.70 g/m$^2$ |
| Phosphoric acid | 0.020 g/m$^2$ |
| Sodium dodecylbenzenesulfonate | 0.015 g/m$^2$ |
| Sodium polystyrenesulfonate | 0.020 g/m$^2$ |
| 1,1'-bis(vinylsulfonyl)methane | 0.030 g/m$^2$ |

The fine-particle dispersions of *Compound Examples, Dye S-10, Dye S-16 and Dye S-30 were each prepared in the same manner as in Example 1.

Emulsion Layer:

To the same emulsion as prepared in Example 1 was first added Sensitizing Dye (2) in an amount of 80 mg per mole of Ag, and then were added disodium 4,4'-bis(4,6-dinaphthoxypyrimidine-2-ylamino)stilbenedisulfonate as a supersensitizer and 2,5-dimethyl-3-allyl-benzothiazole iodide as a stabilizer in amounts of 300 mg and 450 mg respectively per mole of Ag, thereby achieving infrared sensitization. Further, the same antifoggant, plasticizer, hardener and colloidal silica as used in Example 1 were added to the infrared sensitized emulsion. The thus obtained emulsion was coated so as to have a silver coverage of 3.0 g/m$^2$ and a gelatin coverage of 1.2 g/m$^2$. On the emulsion layer were simultaneously coated the upper and the lower protective layers having the individual compositions shown below.

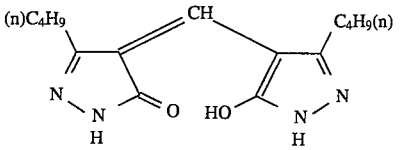

Dye S-10

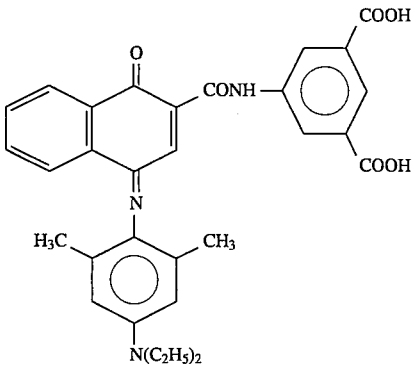

Dye S-16

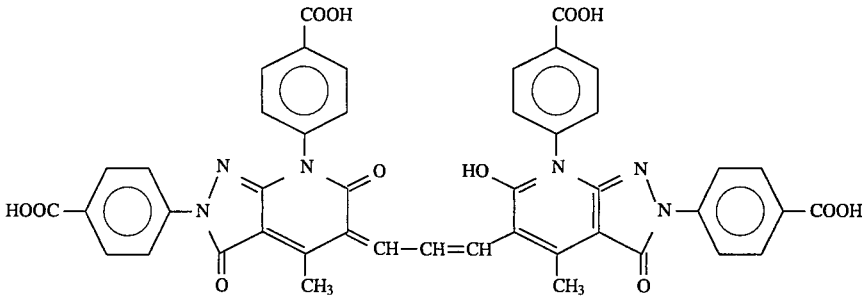

Dye S-30

| | |
|---|---|
| Lower Protective Layer: | |
| Gelatin | 0.25 p/m$^2$ |
| Compound-9 | 20 mg/m$^2$ |
| Compound-10 | 10 mg/m$^2$ |
| Sodium dodecylbenzenesulfonate | 20 mg/m$^2$ |
| Polyethylacrylate latex (0.05 μm) | 150 mg/m$^2$ |
| Upper Protective Layer: | |
| Gelatin | 0.25 g/m$^2$ |
| Fine particles of polymethylmethacrylate (average particle size: 3.4 μm) | 60 mg/m$^2$ |
| Colloidal silica (Snowtex C, products of Nissan Chemicals Industries Ltd.) | 30 mg/m$^2$ |
| Compound (1) (gelatin dispersion of a slipping agent) | 30 mg/m$^2$ |
| Sodium dodecylbenzenesulfonate | 40 mg/m$^2$ |
| Compound Example, Dye S-8 | 50 mg/m$^2$ |
| Compound-11 | 10 mg/m$^2$ |

Sensitizing Dye (2)

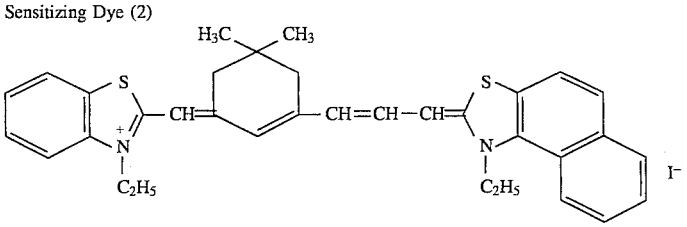

Compound-9

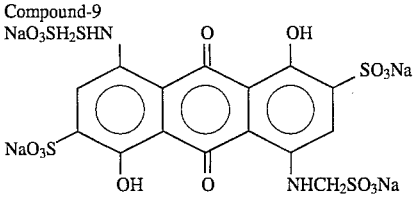

Compound-10

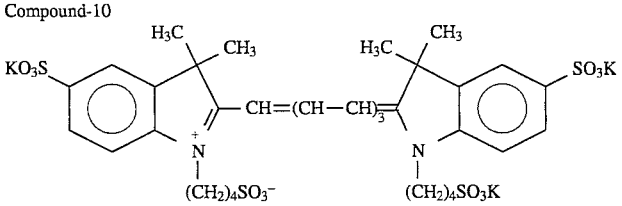

Compound(1)

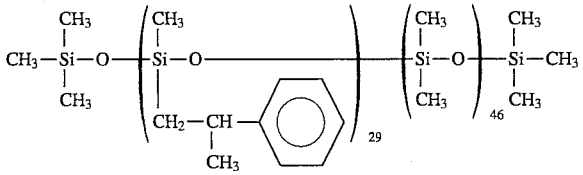

Compound-11

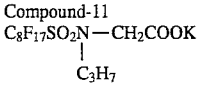

Dye S-8

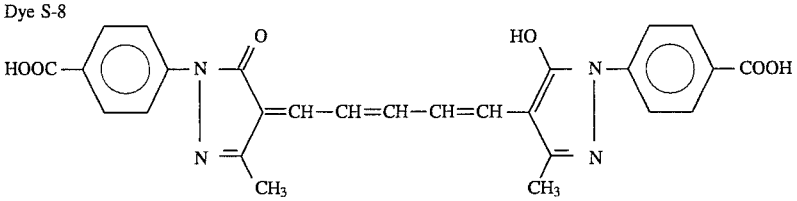

The thus obtained samples were each allowed to stand for 1 week in the atmosphere of 25° C. and 60% RH, and then the drying characteristics and the dimensional change of the resulting samples were evaluated by the same methods used in Example 1 and Example 2 respectively.

The results obtained are shown in Table-3. As can be seen from Table-3, the samples of the present invention exhibited excellent drying characteristics without deterioration of dimensional stability.

TABLE 3

| Sample No. | Backing Layer | Binder of Polymer Layer: Species of Polymer* | Binder of Polymer Layer: Thickness | $d/d_0$ of Backing Layer | $d/d_0$ of Polymer Layer | Swelling Percentage of Emulsion Layer plus Protective Layer | Drying Characteristics** | Rate of Dimensional Change*** |
|---|---|---|---|---|---|---|---|---|
| 8 | absent | P-4 | 0.7 μm | — | 1.00 | 140% | 9 seconds | 0.001% |
| 9 | present | P-4 | 0.7 μm | 1.00 | 1.00 | 140% | 9 seconds | 0.001% |
| 10 | absent | P-5 | 0.7 μm | — | 1.00 | 140% | 9 seconds | 0.001% |
| 11 | present | P-5 | 0.7 μm | 1.00 | 1.00 | 140% | 9 seconds | 0.001% |
| 12 | absent | P-6 | 0.7 μm | — | 1.00 | 140% | 9 seconds | 0.001% |
| 13 | present | P-6 | 0.7 μm | 1.00 | 1.00 | 140% | 9 seconds | 0.001% |
| 14 | present | — | — | 2.10 | — | 140% | 20 seconds | 0.012% |

*P-4: methylmethacrylate/acrylic acid (97:3 by weight) copolymer latex.
P-5: silicone-acryl resin, Siren ARJ-12L, products of Nippon Junyaku Co., Ltd.
P-6: $(methylmethacrylate)_{59}$-$(styrene)_8$-$(2\text{-}ethylhexyl\text{-}acrylate)_{26}$-$(methacrylic\ acid)_{12}$-$(hydroxyethyl\text{-}methacrylate)_5$
**Hot roller temperature: 50° C.
***Surroundings condition: 25° C., 30% RH,
Hot roller temperature: 45° C.

EXAMPLE 4

Sample Nos. 5, 6 and 7 prepared in Example 1 and Sample Nos. 8, 9 and 14 prepared in Example 3 underwent the following running test.

Running Test:

Each sample was subjected to sensitometry and the running test described below under the following processing conditions using the same automatic developing machine as used in Example 1. The developer and the fixer used herein were the same as used in Example 1.

| Processing Conditions | | |
|---|---|---|
| Development | 38° C. | 11.1 seconds |
| Fixation | 36° C. | 10.4 seconds |
| Washing | 25° C. | 10.1 seconds |
| Drying | 50° C. | 8 seconds |
| Total processing time: | | 39.6 seconds |
| Line speed: | | 1800 mm/min |

Running Condition

After an exposure operation was performed in such an exposure amount as to achieve 50% blackening, the processing was continued for 2 weeks under the condition that 130 sheets of photographic films having a quarter size (254 mm×305 mm) were processed per day. The replenishment of processing solutions were carried out in the same manner as in Example 1.

The thus processed photographic films were examined for photographic property and fixation clarity. In the evaluation of the photographic property, the samples prepared in Example 1 were exposed to a xenon flash light having an emission time of $10^{-6}$ second via an interference filter having its peak at 488 nm and a continuous wedge. The samples prepared in Example 3 were also subjected to the same exposure as the samples of Example 1, except that the interference filter used had its peak at 780 nm. The fixation clarity was evaluated by transparency which the unexposed quarter-size photographic film had after photographic processing. The criterion of the evaluation was as follows:

5: transparent over the whole surface

4: transparent over at least ¾ of the whole surface

3: transparent over at least ¾ of the whole surface

2: transparent over at least ¼ of the whole surface

1: opaque over the whole surface

The results obtained are shown in Table 4. As can be seen from Table 4, all samples of the present invention were excellent in both photographic property and drying characteristics even when the replenishment rates of the developer and the fixer were reduced, because the quantity of the developer brought by the present samples into the fixer was small.

TABLE 4

| Sample No. | Replenisment Rate (ml/m²): Developer | Replenisment Rate (ml/m²): Fixer | Photographic Property*: Fresh Solution | Photographic Property*: Running Solution | Fixation Clarity: Fresh Solution | Fixation Clarity: Running Solution | Drying Characteristics** |
|---|---|---|---|---|---|---|---|
| 5 (invention) | 200 | 200 | 100 | 100 | 5 | 5 | good |
| 6 (invention) | " | " | " | " | " | " | " |
| 7 (comparison) | " | " | " | " | " | 4.5 | " |
| 5 (invention) | 100 | 100 | — | " | — | 5 | " |
| 6 (invention) | " | " | — | " | — | " | " |
| 7 (comparison) | " | " | — | " | — | 3.5 | " |
| 8 (invention) | 200 | 200 | 100 | 100 | 5 | 5 | " |
| 9 (invention) | " | " | " | " | " | " | " |
| 14 (comparison) | " | " | " | " | " | 4.5 | " |

TABLE 4-continued

| Sample No. | Replenisment Rate (ml/m²) Developer | Fixer | Photographic Property* Fresh Solution | Running Solution | Fixation Clarity Fresh Solution | Running Solution | Drying Characteristics** |
|---|---|---|---|---|---|---|---|
| 8 (invention) | 100 | 100 | — | " | — | 5 | " |
| 9 (invention) | " | " | — | " | — | " | " |
| 14 (comparison) | " | " | — | " | — | 3.5 | " |

*The sensitivity of each sample was expressed in terms of the reciprocal of the amount of exposure required for providing a density of 3.0. The photographic property is represented by the relative sensitivity, with the sensitivity of Sample 5 or 8 achieved by using the fresh processing solutions being taken as 100.
**Surrounding conditions: 25° C. and 55% RH
Hot roller temperature: 50° C.

EXAMPLE 5

On one side of the same support as used in Example 3 were provided the same conductive, backing and polymer layers as coated in Samples 12 and 13 of Example 3, respectively. On the other side of the support was provided the same colored layer as in Example 3, except that Dye S-21 and Dye S-19 were used in place of Dye S-8 and Dye S-16 respectively, and the same upper and lower protective layers as provided in Example 1 were used. The emulsion used herein was prepared in the same manner as in Example 1, except that it was panchromatically sensitized by addition of Sensitizing Dye (3) in an amount of 100 mg per mole of Ag and further disodium 4,4'-bis(4,6-dinaphthoxypyrimidine-2-ylamino)stilbenedisulfonate as supersensitizer and stabilizer in an amount of 300 mg per mole of Ag. In analogy with the emulsion of Example 1, the emulsion was further admixed with an antifoggant, a plasticizer, a hardener and colloidal silica. The resulting emulsion was coated so as to have a silver coverage of 3.0 g/m² and a gelatin coverage of 1.3 g/m².

The drying characteristics of the thus obtained samples were evaluated by the same method as adopted in Example 1. As a result, these samples have proved to be excellent in drying characteristics, similarly to Sample Nos. 12 and 13 of Example 3.

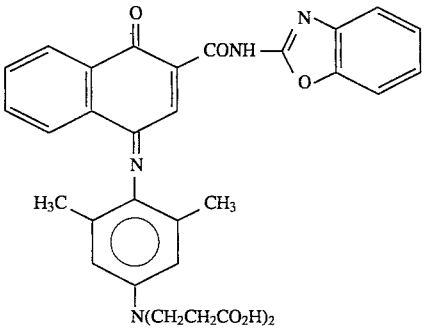

Dye S-19

-continued

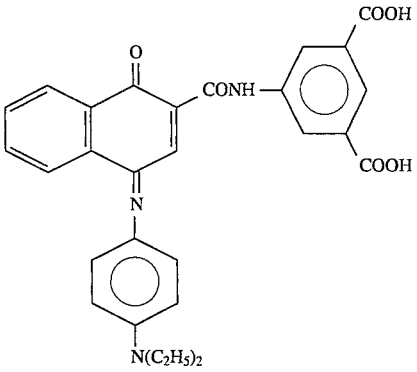

Dye S-21

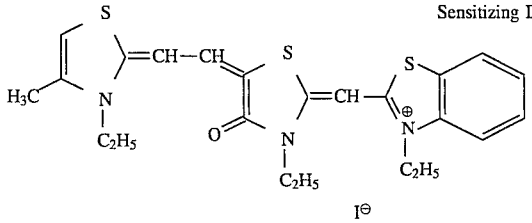

Sensitizing Dye (3)

While the invention has been described in detail and with reference to specific embodiments thereof, it will be apparent to one skilled in the art that various changes and modifications can be made therein without departing from the spirit and scope thereof.

What is claimed is:

1. A method of processing a silver halide photographic material which has been exposed to light and which comprises a support having at least one silver halide emulsion layer on one side thereof and a hydrophobic polymer layer as the outermost layer on the other side thereof, comprising the step of subjecting said photographic material to an automatic developing apparatus, wherein said apparatus comprises a developing unit, a fixing unit, a washing unit, and a drying operation unit, wherein said drying operation unit is equipped with at least two hot rollers which have a peripheral part heated with a heat source, said hot rollers being arranged so that the photographic material wraps partly around each of the hot rollers in turn, so that contact between the photographic material and the hot rollers alternates between the two sides of the photographic material, and so that heat is applied to the photographic material in an amount determined by the temperature of the peripheral part of the hot rollers and the duration of the contact between the photographic material and the hot rollers, whereby moisture in the photographic material evaporates from surface areas of the photographic material which are not in contact with the hot rollers;

wherein the silver halide photographic material has a light-insensitive hydrophilic colloid layer containing a hydrophilic colloid as a binder between the support and the hydrophobic polymer layer, and wherein the combination of the light-insensitive hydrophilic colloid layer and the hydrophobic polymer layer as a whole does not substantially swell during photographic processing; and wherein the automatic developing apparatus has a total processing time from 15 to 60 seconds and a line speed of at least 1,000 mm/min.

2. The processing method described in claim 1, wherein the peripheral temperature of each hot roller is determined by the temperature and the humidity of an atmosphere in which the automatic developing apparatus is placed.

3. The processing method described in claim 1, wherein the automatic developing apparatus has a replenishment rate of at most 200 ml per $m^2$ of the photographic material with respect to the developer and/or the fixer used in said operation parts.

4. The processing method described in claim 1, said photographic material further comprising a light-insensitive hydrophilic colloid layer colored with a dye, said light-insensitive hydrophilic colloid layer being located between the support and the at least one emulsion layer and/or located on the side of the at least one emulsion layer opposite the support.

* * * * *